US011831110B2

(12) United States Patent
Yu

(10) Patent No.: US 11,831,110 B2
(45) Date of Patent: Nov. 28, 2023

(54) ELECTRICAL CONNECTOR

(71) Applicant: T-CONN PRECISION CORPORATION, New Taipei (TW)

(72) Inventor: Chien-Yi Yu, New Taipei (TW)

(73) Assignee: T-CONN PRECISION CORPORATION, New Taipei (TW)

( * ) Notice: Subject to any disclaimer, the term of this patent is extended or adjusted under 35 U.S.C. 154(b) by 238 days.

(21) Appl. No.: 17/529,688

(22) Filed: Nov. 18, 2021

(65) Prior Publication Data

US 2023/0084115 A1 Mar. 16, 2023

(30) Foreign Application Priority Data

Sep. 13, 2021 (TW) ..... 110134083

(51) Int. Cl.

| | |
|---|---|
| ***H01R 24/38*** | (2011.01) |
| ***H01R 13/10*** | (2006.01) |
| ***H01R 13/502*** | (2006.01) |
| *H01R 105/00* | (2006.01) |

(52) U.S. Cl.

CPC ..... *H01R 24/38* (2013.01); *H01R 13/10* (2013.01); *H01R 13/502* (2013.01); *H01R 2105/00* (2013.01); *H01R 2201/26* (2013.01)

(58) Field of Classification Search

CPC ..... H01R 24/38; H01R 13/10; H01R 13/502; H01R 2105/00; H01R 2201/26; H01R 13/44; H01R 2103/00

See application file for complete search history.

(56) References Cited

U.S. PATENT DOCUMENTS

| | | | | |
|---|---|---|---|---|
| 10,446,961 | B1 * | 10/2019 | Chang | H01R 24/38 |
| 2023/0084115 | A1 * | 3/2023 | Yu | H01R 13/44 439/675 |

* cited by examiner

*Primary Examiner* — Abdullah A Riyami
*Assistant Examiner* — Nader J Alhawamdeh
(74) *Attorney, Agent, or Firm* — Birch, Stewart, Kolasch & Birch, LLP

(57) ABSTRACT

An electrical connector has a test terminal, a positive terminal, and a negative terminal coaxially mounted in a connector base. The negative terminal surrounds the positive terminal. An insulating cap is mounted between the positive terminal and the negative terminal. A pair of turning engaging parts is formed between the ring body of the insulating cap and the internal surface of the negative terminal and the turning engaging parts are engaged with each other to assemble the insulating cap with the negative terminal by turning the insulating cap. An annular groove is formed in a top of the insulating cap to increase a creepage distance between the negative terminal and the positive terminal to meet requirement of safety specifications.

14 Claims, 10 Drawing Sheets

ELECTRICAL CONNECTOR

BACKGROUND OF THE INVENTION

1. Field of the Invention

The present invention relates to an electrical connector, and more particularly to an electrical connector that has a structure to increase a creepage distance between a negative terminal and a positive terminal of the electrical connector.

2. Description of the Prior Art

Generally, battery replacement is to continue supplying power to an electrical motorcycle. The battery and the electrical motorcycle are connected with each other via two corresponding connectors respectively mounted in the battery and the electrical motorcycle and detachably connected with each other. With reference to FIG. 7, a conventional electrical connector (female end) generally mounted on the battery has a negative terminal 81, a positive terminal 82, and a test terminal 83 coaxially disposed in a connector base 80. The test terminal 83 is disposed in an axis of the connector base 80. The positive terminal 82 is tubular and coaxially surrounds the test terminal 83. The negative terminal 81 is tubular, has an internal diameter being larger than an external diameter of the positive terminal 82, and coaxially surrounds the positive terminal 82.

Lower ends of the negative terminal 81 and the positive terminal 82 are electrically isolated from each other via the connector base 80. An annular gap is formed between upper ends of the negative terminal 81 and the positive terminal 82. An insulating cap 90 is disposed in the annular gap to ensure that the upper ends of the negative terminal 81 and the positive terminal 82 are also electrically isolated from each other. With reference to FIGS. 8 and 9, the insulating cap 90 substantially has a cap portion 91 and multiple curved catching pieces 92 extending downwardly from a bottom of the cap portion 91 in an annular arrangement. Each of the catching pieces 92 has an engaging protrusion 920 located near a bottom thereof. A respective space is formed between each two of the catching pieces 92 adjacent to each other. The internal diameter of the negative terminal 81 corresponds to the catching pieces 92 in size and shape. A hole flange 810 is formed around an opening in the negative terminal 81 and radially extends toward an axis direction of the negative terminal 81. In other words, a hole diameter at the hole flange 810 is smaller than the internal diameter of the negative terminal 81.

When the insulating cap 90 is inserted into the annular gap between the negative terminal 81 and the positive terminal 82. The catching pieces 92 are compressed to decrease the spaces therebetween, so the engaging protrusions 920 near the bottom of the catching pieces 92 can easily pass through the hole flange 810 of the negative terminal 81. After the engaging protrusions 920 have passed through the hole flange 810, the catching pieces 92 are released, and the engaging protrusions 920 engage with the hole flange 810 of the negative terminal 81 to complete assembly of the insulating cap 90. Because the insulating cap 90 is served as an insulating medium between the negative terminal 81 and the positive terminal 82, its specification must meet the standard safety specification requirements.

National Standard of People's Republic of China GB 24155-2020 "Safety specifications for electric motorcycles and electric mopeds" defines specifications for creepage distance and electrical clearance of the charging interface. The creepage distance related to storage battery should meet specifications as follows:

1. A creepage distance d1 between connection terminals of the storage battery is determined according to formula (1) below, wherein unit of the creepage distance d1 is millimeter:

$$d1 \geq 0.25U+5 \quad (1)$$

2. A creepage distance d2 between live part and charging platform is determined according to formula (2) below, wherein unit of the creepage distance d2 is millimeter:

$$D2 \geq 0.125U+5 \quad (2)$$

U defined in aforementioned formulae (1) and (2) is a maximum working voltage between two output terminals of the storage battery, wherein unit of the working voltage is volt.

In addition, an electrical clearance between conductive parts should not be smaller than 2.5 millimeters.

Measurements of the electrical clearance and the creepage distance are as shown in FIG. 10. Two connection terminals 71, 72 are disposed on a carrier 70. Each of the two connection terminals 71, 72 has a conductive surface 710, 720. A distance between the two conductive surfaces 710, 720 is an electrical clearance G. A distance between the two connection terminals 71, 72 measured along a surface of the carrier 70 is a creepage distance D.

According to above mentioned requirements of the safety specifications, a creepage distance of the electrical connector from the negative terminal 81 to the positive terminal 82 along the insulating cap 90 being the insulating medium must meet the above mentioned requirement of the safety specifications. However, as shown in FIG. 8, the creepage distance between the negative terminal 81 and the positive terminal 82 includes two paths, which are $\overline{AB}$ and $\overline{CD}$. The path $\overline{AB}$ is a distance from the negative terminal 81 along a surface of the cap portion 91 of the insulating cap 90 to the positive terminal 82. The path $\overline{CD}$ is a distance from the negative terminal 81 along a bottom surface of the annular gap to the positive terminal 82. However, neither $\overline{AB}$ nor $\overline{CD}$ meets the above mentioned requirement of the safety specifications. In other words, the conventional electrical connector does not meet the safety requirement.

Accordingly, the conventional electrical connector cannot meet the safety requirement for the creepage distance. A solution for this issue is needed.

To overcome the shortcomings, the present invention provides an electrical connector to mitigate or obviate the aforementioned problems.

SUMMARY OF THE INVENTION

The main objective of the present invention is to provide an electrical connector that has a special insulating cap and assembling structures to increase a creepage distance between a positive terminal and a negative terminal of the electrical connector to meet the requirement for safety specifications.

To achieve the foregoing purpose, the electrical connector comprises a test terminal, a positive terminal, and a negative terminal coaxially mounted in a connector base and electrically isolated from one another, and an insulating cap mounted between the positive terminal and the negative terminal. The test terminal is disposed in an axis of the connector base and has an upper end and a lower end. The positive terminal is tubular, surrounds the test terminal, and has an upper end and a lower end. The negative terminal is tubular, surrounds the positive terminal, and has an upper end and a lower end. An annular gap is formed between the upper end of the negative terminal and the upper end of the positive terminal for mounting the insulating cap.

The insulating cap has a cap portion, a ring body extending downwardly from a bottom of the cap portion, and an annular groove coaxially formed in a top of a surface of the cap portion, longitudinally extending into the ring body, and is kept from extending through a bottom of the ring body. A pair of turning engaging parts is formed between the ring body of the insulating cap and an internal surface of the negative terminal and the turning engaging parts are engaged with each other by turning the insulating cap relative to the negative terminal to assemble the insulating cap in the annular gap between the negative terminal and the positive terminal by turning the insulating cap.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
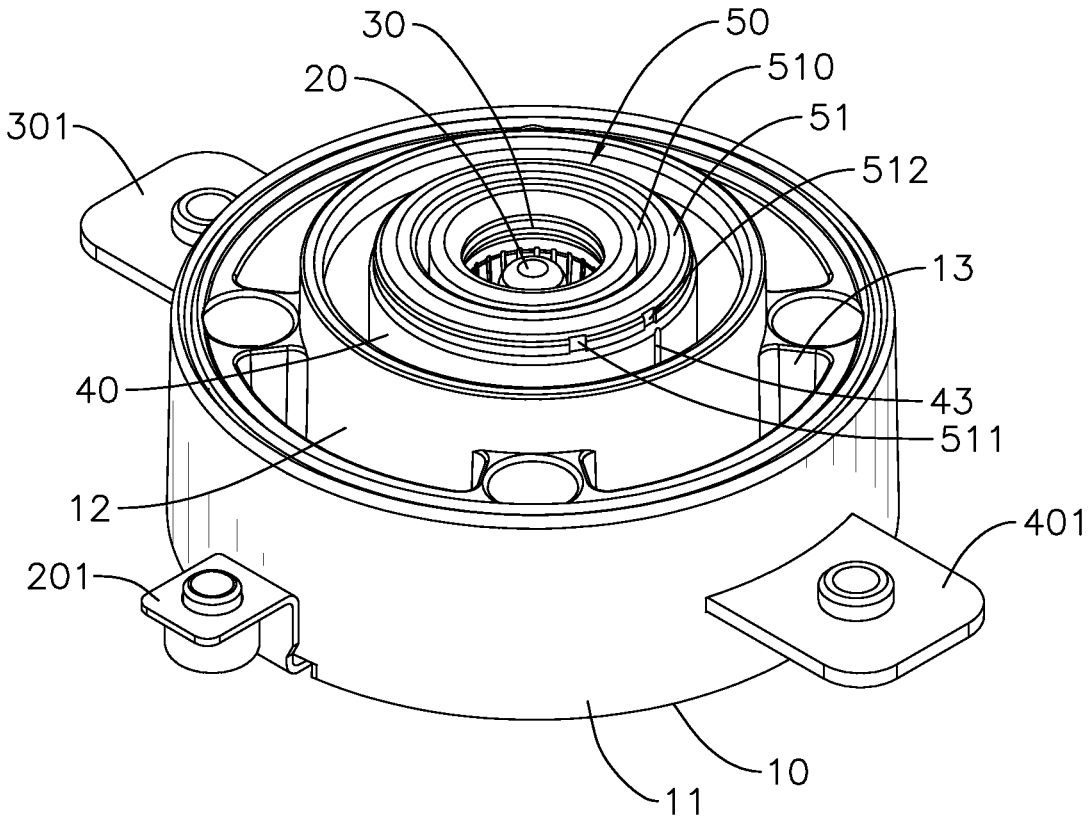
FIG. 1 is a perspective view of an electrical connector in accordance with the present invention.
Figure 2:
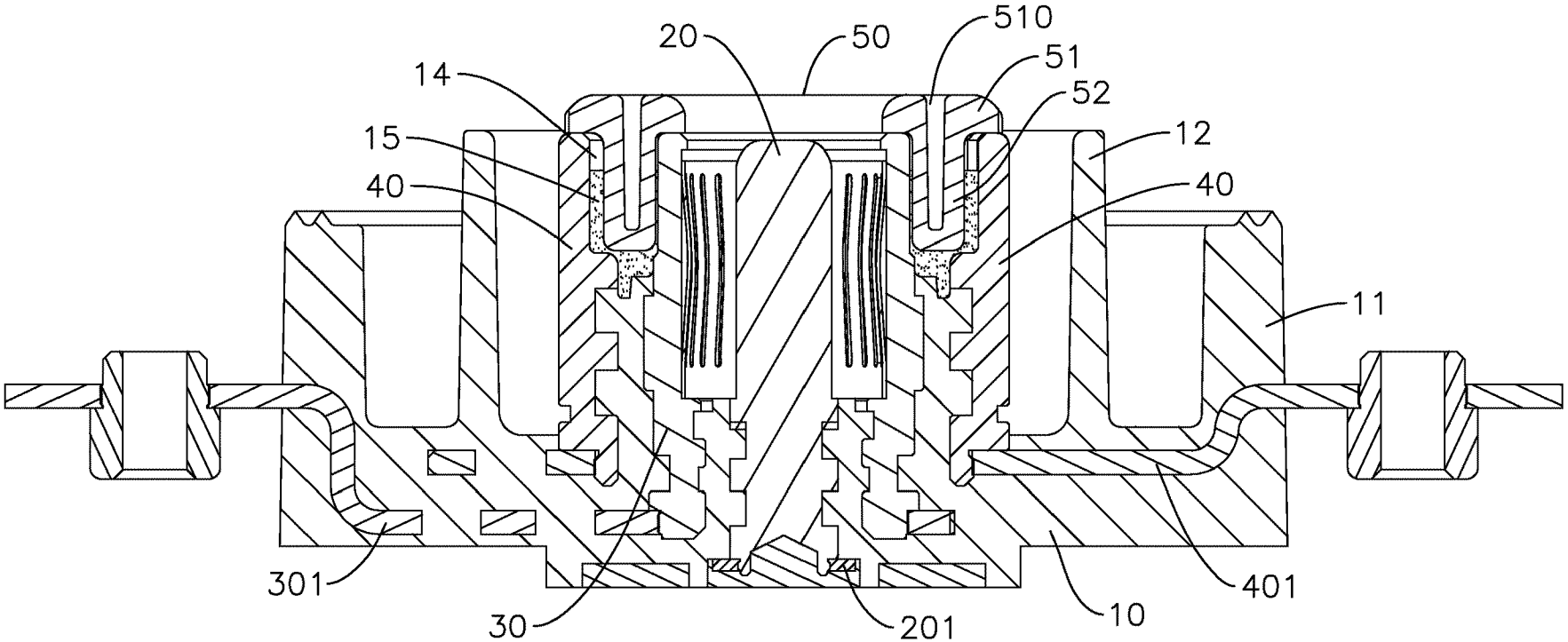
FIG. 2 is a cross sectional side view of the electrical connector in FIG. 1.

With reference to FIGS. 1 and 2, an electrical connector in accordance with the present invention comprises a test terminal 20, a positive terminal 30, and a negative terminal 40 coaxially mounted in a connector base 10 and electrically isolated from one another, and an insulating cap 50 mounted between the positive terminal 30 and the negative terminal 40.

In the embodiment, the connector base 10 is cylindrical, is made of an insulation material, and has a bottom portion, an external ring 11, and an internal ring 12, wherein the external ring 11 and the internal ring 12 extend vertically and upwardly from the bottom portion of the connector base 10 coaxially. Multiple connecting ribs 13 are formed between the external ring 11 and the internal ring 12. The test terminal 20 is disposed in an axis of the connector base 10. A lower end of the test terminal 20 is fixed in the bottom portion of the connector base 10, and an upper end of the test terminal 20 is coaxially located inside the internal ring 12.

The positive terminal 30 is tubular, has an internal diameter larger than an external diameter of the test terminal 20, coaxially surrounds the test terminal 20, and is located between the test terminal 20 and the internal ring 12 of the connector base 10. A lower end of the positive terminal 30 is fixed in the bottom portion of the connector base 10. An upper end of the positive terminal 30 is coaxially located inside the internal ring 12.

Figure 3:
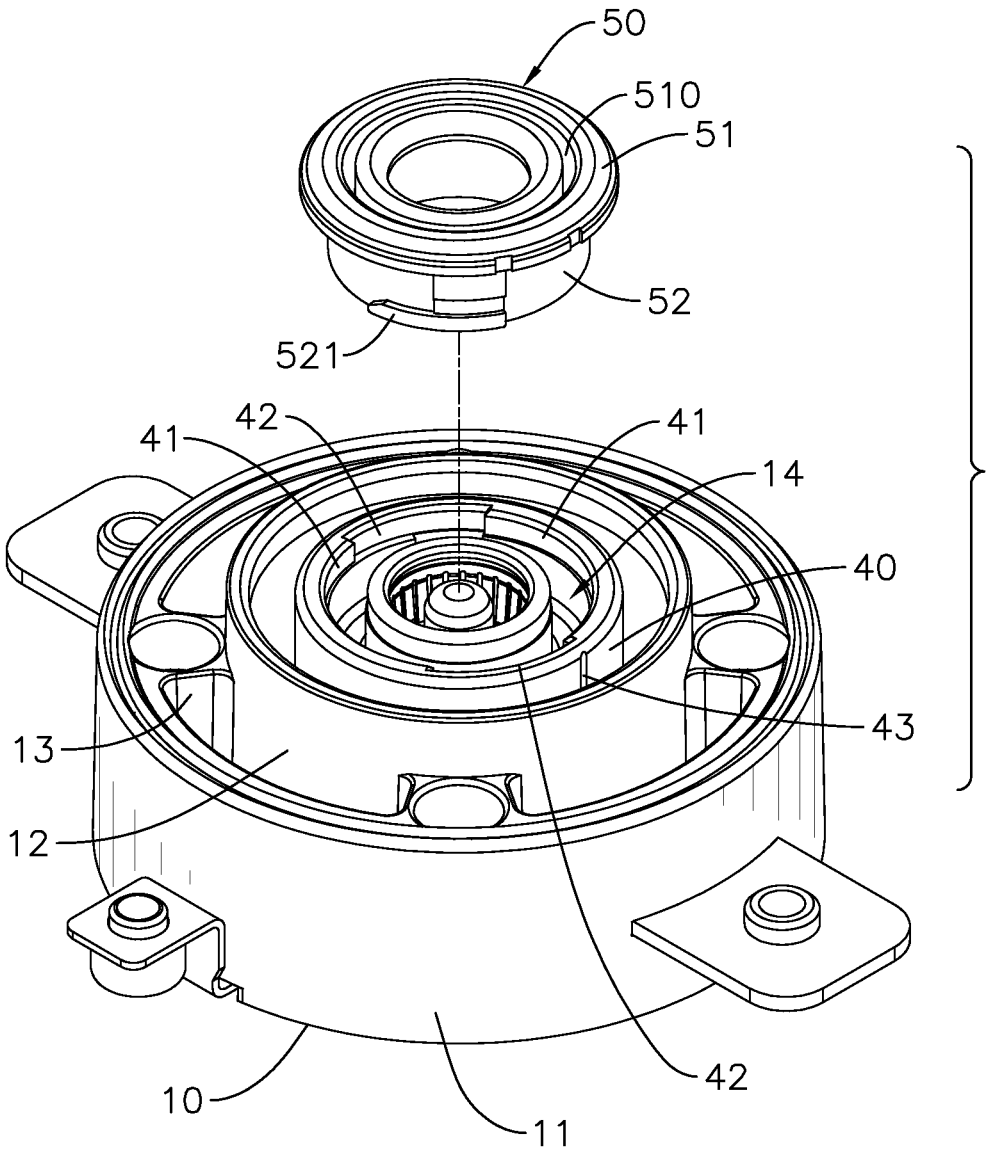
FIG. 3 is an exploded perspective view of the electrical connector in FIG. 1.

With reference to FIGS. 2 and 3, the negative terminal 40 is tubular, has an internal diameter larger than an external diameter of the positive terminal 30, and coaxially surrounds the positive terminal 30. A lower end of the negative terminal 40 is fixed in the bottom portion of the connector base 10 and is isolated from the lower end of the positive terminal 30. An upper end of the negative terminal 40 is coaxially located inside the internal ring 12. An annular gap 14 is formed between the upper end of the negative terminal 40 and the upper end of the positive terminal 30 for mounting the insulating cap 50.

Figure 4:
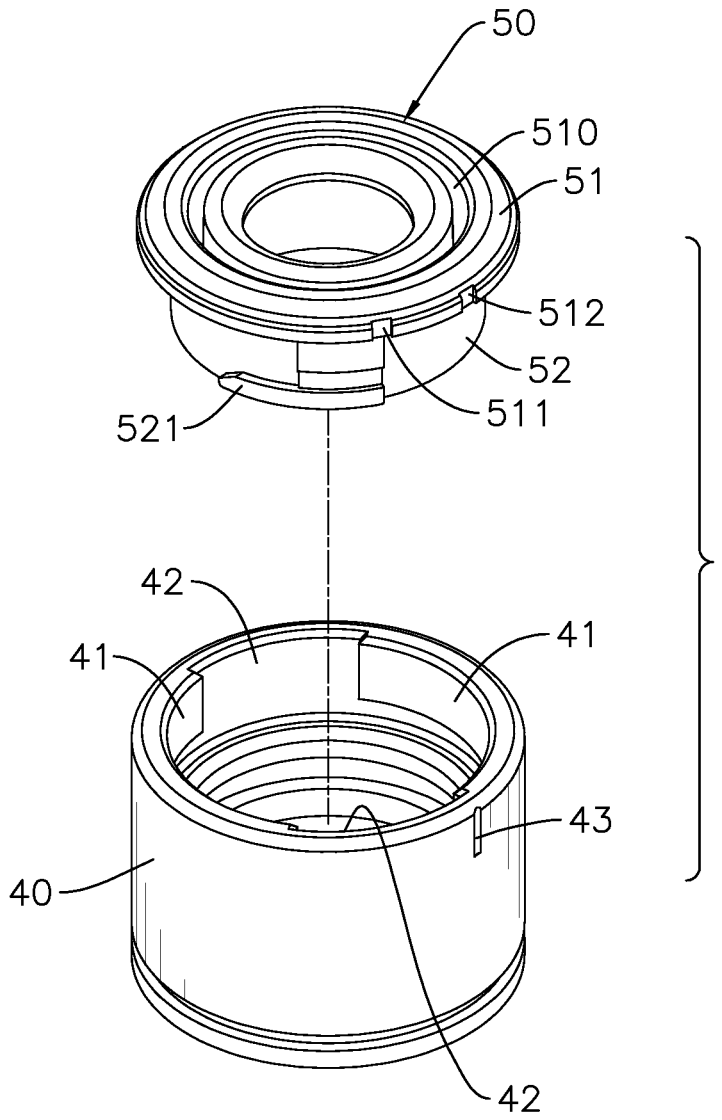
FIG. 4 is an enlarged exploded perspective view of a negative terminal and an insulating cap of the electrical connector in FIG. 1, wherein some components are omitted.

With reference to FIG. 4, the insulating cap 50 has a cap portion 51 and a ring body 52 extending downwardly from a bottom of the cap portion 51. The cap portion 51 is discoidal and has a through hole coaxially formed through a center of the cap portion 51. The through hole has a hole diameter corresponding to the internal diameter of the positive terminal 30 in size and position. An external diameter of the cap portion 51 is larger than the internal diameter of the negative terminal 40. Thus, the cap portion 51 covers the upper ends of the negative terminal 40 and the positive terminal 30. An annular groove 510 is coaxially formed in a top of a surface of the cap portion 51, longitudinally extends into the ring body 52, and is kept from extending through a bottom of the ring body 52. Particularly, on the premise that the annular groove 510 is not formed through the bottom of the ring body 52, a depth of the annular groove 510 is increased as much as possible to increase a distance from an external annular periphery to an internal annular periphery (hole edge of the through hole) of the cap portion 51 along the surface thereof. Whereby a creepage distance between the negative terminal 40 and the positive terminal 30 is greatly increased.

In addition, a pair of turning engaging parts is formed between the ring body 52 of the insulating cap 50 and the internal surface of the negative terminal 40 and the turning engaging parts are engaged with each other by turning the insulating cap 50 relative to the negative terminal 40 to assemble the insulating cap 50 in the annular gap 14 between the negative terminal 40 and the positive terminal 30 by turning the insulating cap 50 relative to the negative terminal 40. The ring body 52 has an internal diameter corresponding to the external diameter of the positive terminal 30 in size for the ring body 52 to surround and be sleeved on the positive terminal 30. The pair of the turning engaging parts comprises at least one engaging block 521 radially formed on an external annular surface of the ring body 52 and located near the bottom of the ring body 52 and at least one blocking protrusion 41 radially formed on the internal surface of the negative terminal 40.

In the embodiment, two said engaging blocks 521 are formed on the external annular surface of the ring body 52, are located near the bottom of the ring body 52, and are diametrically opposite each other. Two said blocking protrusions 41 respectively correspond to the two engaging blocks 521 in position, are formed on the internal surface of the negative terminal 40, and are diametrically opposite each other. The two said blocking protrusions 41 are located near an opening of the negative terminal 40. Gaps 42 are formed between respective adjacent ends of the two said blocking protrusions 41, and each of the gaps 42 has a width being larger than a length of each of the engaging blocks 521 for each of the engaging blocks 521 to pass through the gap 42.

Figure 5:
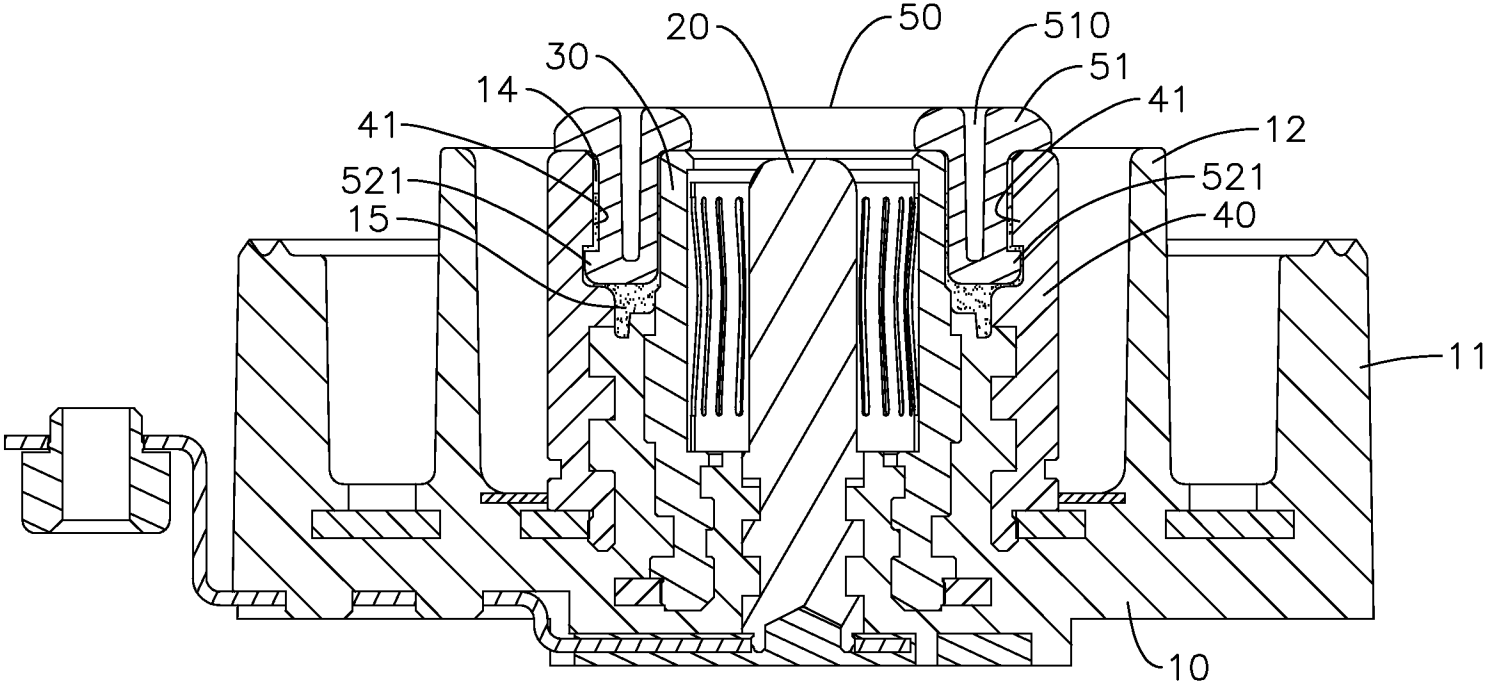
FIG. 5 is another cross sectional side view of the electrical connector in FIG. 1.

After the engaging blocks 521 near the bottom of the ring body 52 of the insulating cap 50 are aligned with the gaps 42 located near the opening of the negative terminal 40, the insulating cap 50 is moved down to insert in the annular gap 14 between the negative terminal 40 and the positive terminal 30, and then the insulating cap 50 is rotated at an angle to turn the engaging blocks 521 near the bottom of the ring body 52 to locate below the blocking protrusion 41 near the opening of the negative terminal 40. With reference to FIG. 5, after that, the engaging blocks 521 are blocked by the blocking protrusions 41, and installation and fixing of the insulating cap 50 is completed. Each of the engaging blocks 521 has a first end, a second end, and a bevel formed in the first end and located away from the bottom of the ring body 52. The engaging block 521 can be easily turned into a position below the blocking protrusion 41 from the first end and tightly abut against the blocking protrusion 41 via guiding of the bevel of the engaging blocks 521.

To exactly rotate the insulating cap 50 at a specified angle to fix the insulating cap 50, a start mark 511 is formed in an edge of the cap portion 51 and is located at a position corresponding to the second end of one of the engaging blocks 521, and an end mark 512 is formed in the edge of the cap portion 51 at a position corresponding to an outer position with respect to the engaging block 521 opposite to the first end thereof and is spaced apart from the second end thereof. An angle formed between the end mark 512 and the start mark 511 is smaller than an angle formed between the first end and the second end of each of the engaging blocks 521. A position mark 43 is formed in the external surface of the negative terminal 40 and is located at a position corresponding to an end of one of the gaps 42. The position mark 43 corresponds to the start mark 511 in the cap portion 51 in position.

To mount the insulating cap 50 in the annular gap 14 between the negative terminal 40 and the positive terminal 30, the start mark 511 in the cap portion 51 is aligned with the position mark 43 in the external surface of the negative terminal 40, and then the insulating cap 50 is inserted in the annular gap 14 and is rotated to turn the end mark 512 to align with the position mark 43 in the external surface of the negative terminal 40 as shown in FIG. 1. At this time, the engaging blocks 521 near the bottom of the ring body 52 are turned to directly below the blocking protrusions 41 to fix the insulating cap 50. Accordingly, the installation of the insulating cap 50 is more convenient and faster.

Figure 6:
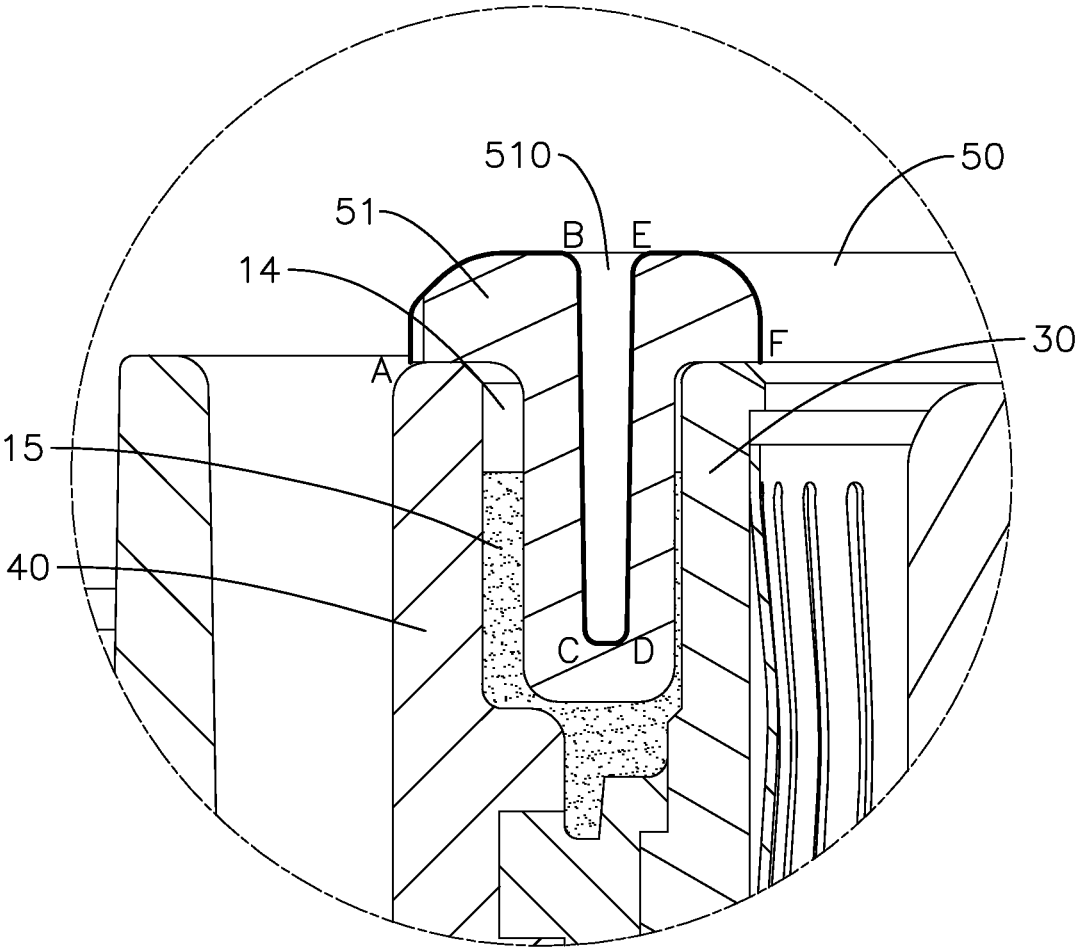
FIG. 6 is an enlarged cross sectional side view of the electrical connector in FIG. 5.
Figure 7:
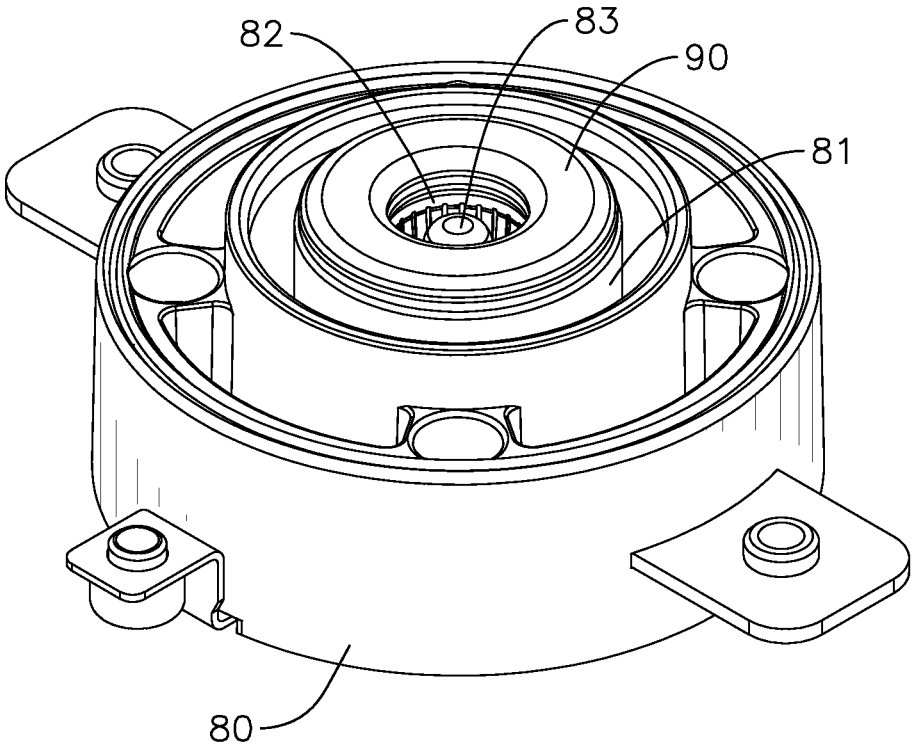
FIG.7 PRIOR ART
FIG. 7 is a perspective view of an electrical connector in accordance with a prior art.
Figure 8:
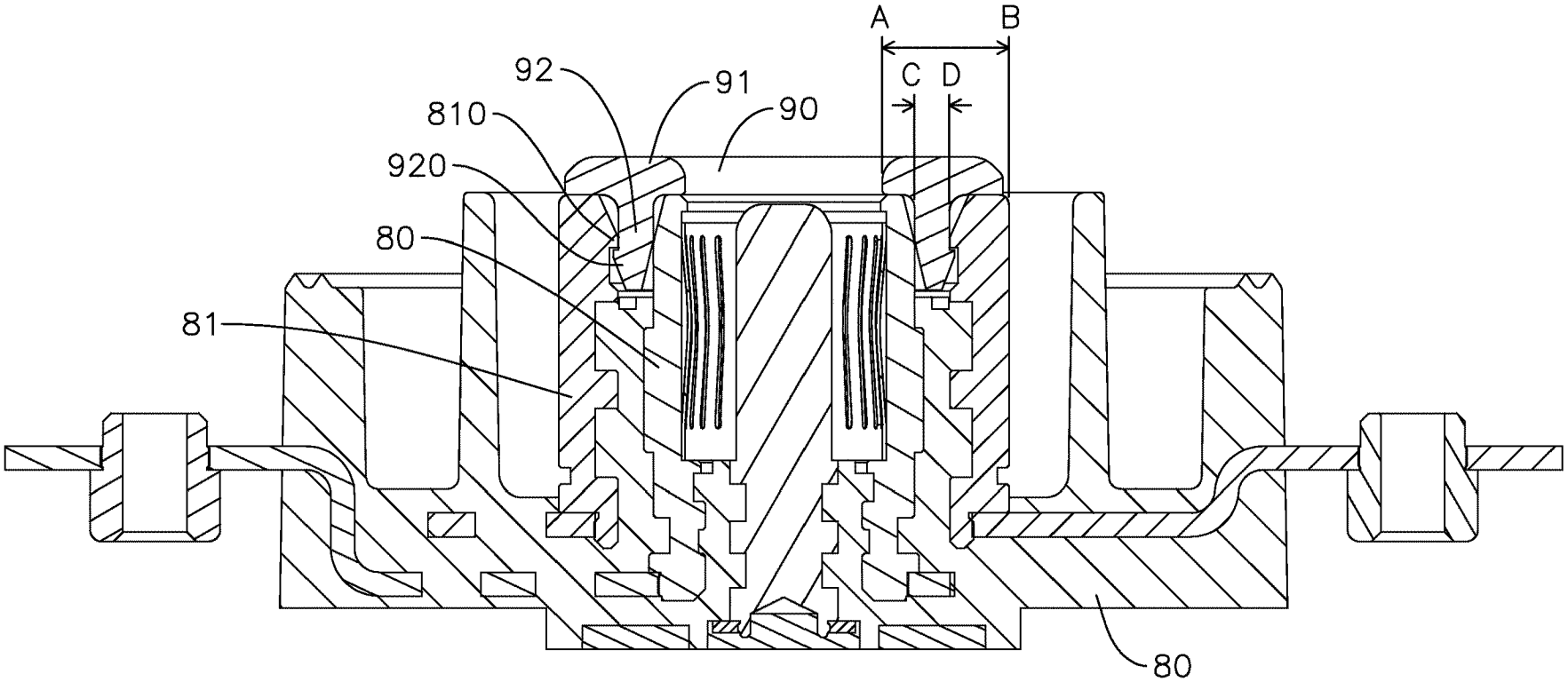
FIG. 8 PRIOR ART
FIG. 8 is a cross sectional side view of the electrical connector in FIG. 7.
Figure 9:
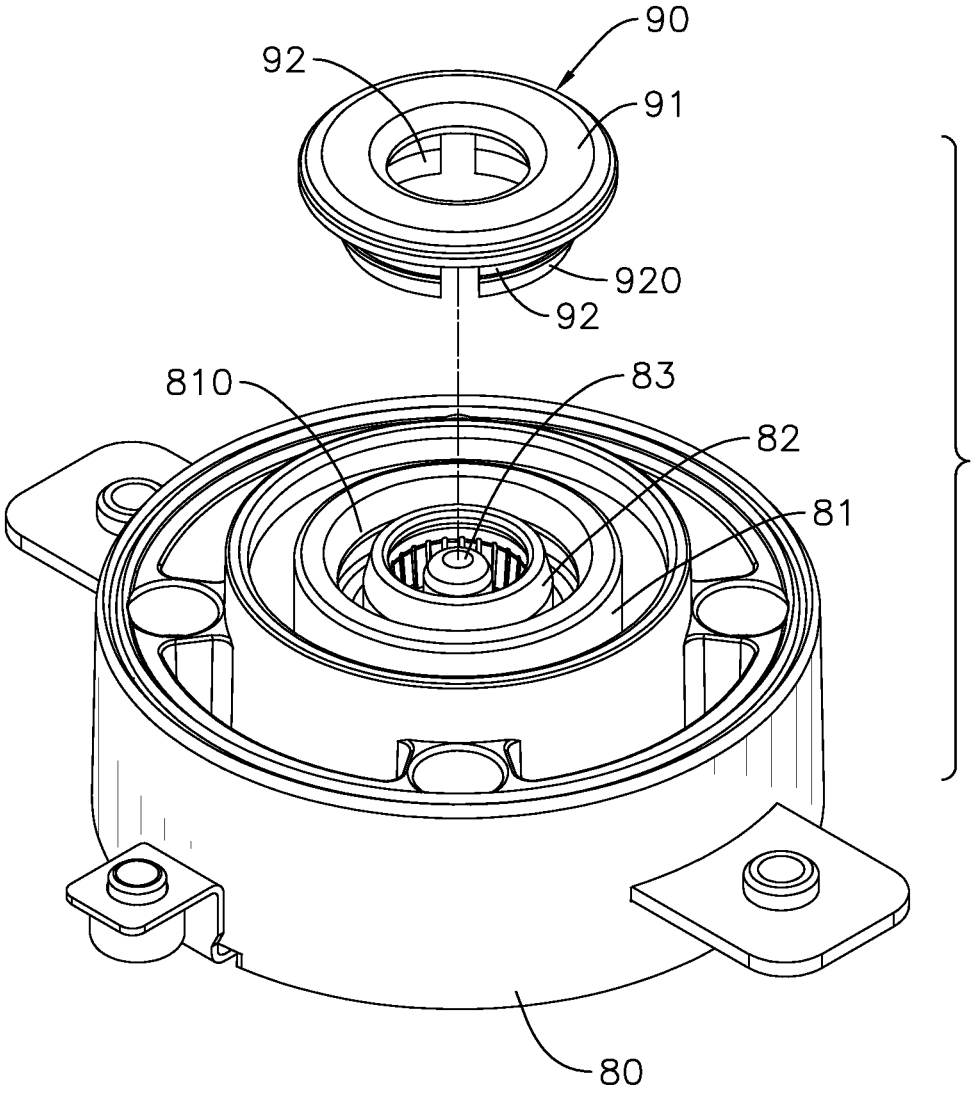
FIG.9 PRIOR ART
FIG. 9 is an exploded perspective view of the electrical connector in FIG. 7.
Figure 10:
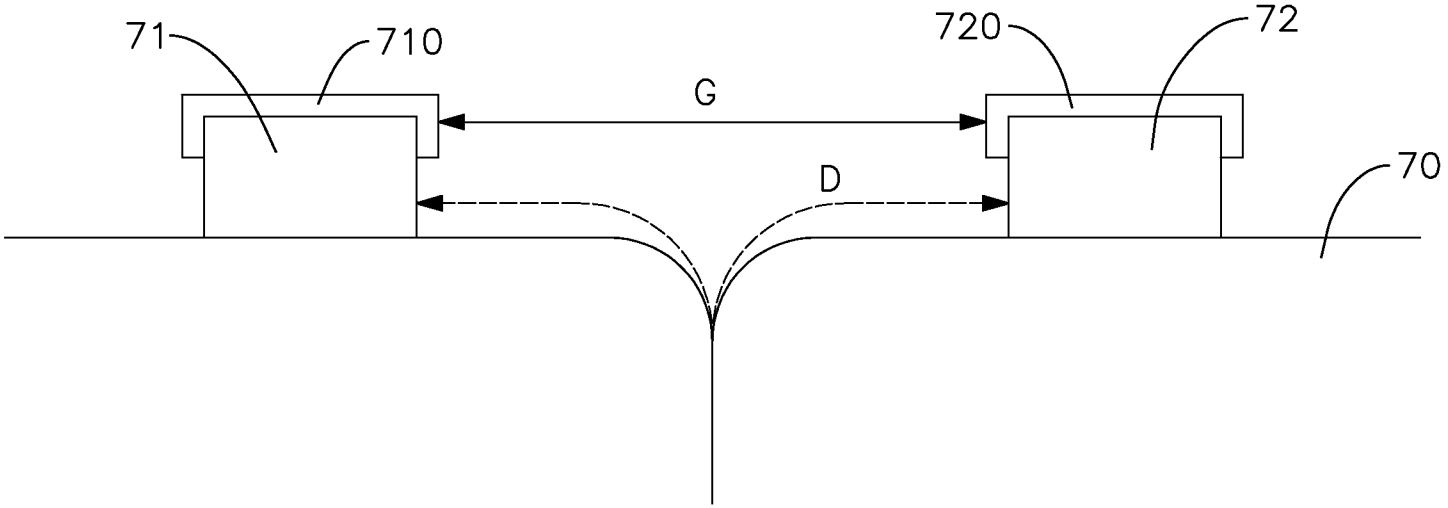
FIG. 10 PRIOR ART
FIG. 10 a schematic diagram showing measurement for creepage distance and electrical clearance.

With reference to FIG. 5, to ensure the surface of the cap portion 51 of the insulating cap 50 is the only insulation surface between the negative terminal 40 and the positive terminal 30, before the insulating cap 50 is installed, an insulation glue 15 is filled in the annular gap 14 between the negative terminal 40 and the positive terminal 30. The insulation glue 15 fills up a bottom of the annular gap 14 up to a position above the engaging blocks 521 of the insulating cap 50, so the insulation glue 15 is filled in the annular gap 14 after the insulating cap 50 is installed, and a top of the insulation glue 15 is disposed above the engaging blocks 521. Accordingly, the surface of the cap portion 51 of the insulating cap 50 is the only insulation surface between the negative terminal 40 and the positive terminal 30. The annular groove 510 in the top of the surface of the cap portion 51 greatly increases a creepage distance from the negative terminal 40 to the positive terminal 30 along the insulation surface. The standard requirement of safety specifications is met. With reference to FIG. 6, the creepage distance from the negative terminal 40 along the surface of the cap portion 51 to the positive terminal 30 is summation of distances ($\overline{AB}+\overline{BC}+\overline{CD}+\overline{DE}+\overline{EF}$). Compared to the creepage distance along the cap portion 51 of the insulating cap 50 of the conventional electrical connector, the creepage distance in the electrical connector of the present invention is greatly increased to meet the standard requirement of safety specifications.

With reference to FIGS. 1 and 2, a test conductive sheet 201 is conductively connected to the lower end of the test terminal 20, a positive conductive sheet 301 is conductively connected to the lower end of the positive terminal 30, and a negative conductive sheet 401 is conductively connected to the lower end of the negative terminal 40. The test conductive sheet 201, the positive conductive sheet 301, and the negative conductive sheet 401 each have one respective end extending into the bottom portion of the connector base 10 and the other ends of the test conductive sheet 201, the positive conductive sheet 301, and the negative conductive sheet 401 extending out from the bottom portion of the connector base 10.

As mentioned above, the annular groove 510 is coaxially formed in the surface of the insulating cap 50 mounted between the negative terminal 40 and the positive terminal 30 and is coaxially located between the negative terminal 40 and the positive terminal 30. The surface of the cap portion 51 of the insulating cap 50 is the insulation surface between the negative terminal 40 and the positive terminal 30. Because of the annular groove 510, the insulation surface between the negative terminal 40 and the positive terminal 30 is increased. Therefore, the creepage distance between the negative terminal 40 and the positive terminal 30 is greatly increased to meet the standard requirement of safety specifications.

What is claimed is:

1. An electrical connector comprising a test terminal, a positive terminal, and a negative terminal coaxially mounted in a connector base and electrically isolated from one another, and an insulating cap mounted between the positive terminal and the negative terminal, wherein the test terminal is disposed in an axis of the connector base and has an upper end and a lower end;

the positive terminal is tubular, surrounds the test terminal, and has an upper end and a lower end;

the negative terminal is tubular, surrounds the positive terminal, and has an upper end and a lower end, and an annular gap is formed between the upper end of the negative terminal and the upper end of the positive terminal for mounting the insulating cap;

the insulating cap has a cap portion, a ring body extending downwardly from a bottom of the cap portion, and an annular groove coaxially formed in a top of a surface of the cap portion, longitudinally extending into the ring body, and is kept from extending through a bottom of the ring body; and a pair of turning engaging parts is formed between the ring body of the insulating cap and an internal surface of the negative terminal and the turning engaging parts are engaged with each other by turning the insulating cap relative to the negative terminal to assemble the insulating cap in the annular gap between the negative terminal and the positive terminal by turning the insulating cap relative to the negative terminal.

2. The electrical connector as claimed in claim 1, wherein the pair of the turning engaging parts comprises at least one engaging block radially formed on an external annular surface of the ring body and located near the bottom of the ring body of the insulating cap; and at least one blocking protrusion radially formed on the internal surface of the negative terminal.

3. The electrical connector as claimed in claim 2, wherein two said engaging blocks are radially formed on the external annular surface of the ring body, are located near the bottom of the ring body of the insulating cap, and are diametrically opposite each other;

two said blocking protrusions are formed on the internal surface of the negative terminal and are diametrically opposite each other; and multiple gaps are respectively formed between respective adjacent ends of the two said blocking protrusions and each of the gaps has a width being larger than a length of each of the two said engaging blocks.

4. The electrical connector as claimed in claim 2, wherein each of the at least one engaging block has a first end, a second end, and a bevel formed in the first end and located away from the bottom of the ring body.

5. The electrical connector as claimed in claim 3, wherein each of the two said engaging blocks has a first end and a second end;

a start mark is formed in an edge of the cap portion of the insulating cap and is located at a position corresponding to the second end of one of the two said engaging blocks;

an end mark is formed in the edge of the cap portion of the insulating cap and is located at a position corresponding to an outer position with respect to the engaging block and spaced apart from the second end of the engaging block;

an angle between the end mark and the start mark is smaller than the an angle between the first end and the second end of each of the two said engaging blocks; and a position mark is formed in an external surface of the negative terminal, is located at a position corresponding to an end of one of the gaps, and corresponds to the start mark in position.

6. The electrical connector as claimed in claim 3, wherein the cap portion is discoidal and has a through hole coaxially formed through a center of the cap portion;

the through hole has a hole diameter corresponding to an internal diameter of the positive terminal in size and position; and the cap portion has an external diameter being larger than an internal diameter of the negative terminal and covers the upper ends of the negative terminal and the positive terminal.

7. The electrical connector as claimed in claim 2, wherein an insulation glue is filled in the annular gap between the negative terminal and the positive terminal, and a top of the insulation glue is disposed above the at least one engaging block of the insulating cap.

8. The electrical connector as claimed in claim 3, wherein an insulation glue is filled in the annular gap between the negative terminal and the positive terminal, and a top of the insulation glue is disposed above the engaging blocks of the insulating cap.

9. The electrical connector as claimed in claim 4, wherein an insulation glue is filled in the annular gap between the negative terminal and the positive terminal, and a top of the insulation glue is disposed above the at least one engaging block of the insulating cap.

10. The electrical connector as claimed in claim 5, wherein an insulation glue is filled in the annular gap between the negative terminal and the positive terminal, and a top of the insulation glue is disposed above the engaging blocks of the insulating cap.

11. The electrical connector as claimed in claim 6, wherein an insulation glue is filled in the annular gap between the negative terminal and the positive terminal, and a top of the insulation glue is disposed above the engaging blocks of the insulating cap.

12. The electrical connector as claimed in claim 1, wherein the connector base is cylindrical and has a bottom portion, an external ring, and an internal ring;

the external ring and the internal ring extend vertically and upwardly from the bottom portion of the connector base at coaxial arrangement; and multiple connecting ribs are formed between the external ring and the internal ring.

13. The electrical connector as claimed in claim 8, wherein the lower ends of the test terminal, the positive terminal, and the negative terminal are mounted in the bottom portion of the connector base; and the upper ends of the test terminal, the positive terminal, and the negative terminal are coaxially located inside the internal ring.

14. The electrical connector as claimed in claim 8, wherein a test conductive sheet is conductively connected to the lower end of the test terminal;

a positive conductive sheet is conductively connected to the lower end of the positive terminal;

a negative conductive sheet is conductively connected to the lower end of the negative terminal; and the test conductive sheet, the positive conductive sheet, and the negative conductive sheet each have one respective end extending into the bottom portion of the connector base and the other ends of the test conductive sheet, the positive conductive sheet, and the negative conductive sheet extending out from the bottom portion of the connector base.

* * * * *